United States Patent [19]

Sperling

[11] 3,943,989

[45] Mar. 16, 1976

[54] BALL HOLDER

[76] Inventor: Charles A. Sperling, c/o Cross Newform Plastics Co., Inc., 392 W. Boylston St., Worcester, Mass. 01606

[22] Filed: Oct. 9, 1973

[21] Appl. No.: 404,600

[52] U.S. Cl. ..... 150/52 R; 206/470; 273/74

[51] Int. Cl. ..... B65d 65/02; A63b 49/18

[58] Field of Search ..... 150/52 R, 52 A, 52 G; 273/74; 206/470, 473, 467, 315

[56] References Cited

UNITED STATES PATENTS

| | | | |
|---|---|---|---|
| 2,134,411 | 10/1938 | Marx | 150/52 G |
| 2,926,912 | 3/1960 | Gould | 150/52 G |
| 3,174,621 | 3/1965 | Watson | 206/470 |

FOREIGN PATENTS OR APPLICATIONS

| | | | |
|---|---|---|---|
| 1,570,711 | 6/1969 | France | 206/470 |
| 355,496 | 8/1931 | United Kingdom | 273/74 |

*Primary Examiner*—Herbert F. Ross

[57] ABSTRACT

A ball holder includes a cage of a size to snugly hold at least two balls. The cage has an open side which is secured at least partway along its length to one face of a flexible racket cover. When the cover is on the racket, the cover is held taut so that it completely covers the open cage side, with the result that the balls are retained in the cage. However, when the cover is removed from the racket, it becomes limp, thereby exposing the unattached portion of the open cage side so a ball can be placed in and withdrawn from the cage.

5 Claims, 4 Drawing Figures

BALL HOLDER

BACKGROUND OF THE INVENTION

This invention relates to a holder for tennis or squash balls, shuttlecocks or other game objects struck with a racket. It relates more particularly to a holder of this type which is arranged to be attached to one face of a racket cover or other flexible sheath.

Conventional ball holders of the type of interest here are comprised of a pocket stitched or otherwise integrally formed with the fabric or plastic racket cover. The pocket is usually provided with a cover flap having some sort of fastener to secure the flap and thereby retain the pocket contents whether or not the cover is on the racket. This integral pocket increases the manufacturing cost of the cover. Also, in time, the pocket may tear or its fastener may break, so that the pocket no longer performs its function.

SUMMARY OF THE INVENTION

Accordingly, the present invention aims to provide a holder for tennis and squash balls, shuttlecocks and the like which is relatively inexpensive to make.

Another object of the invention is to provide a holder of this type which can be installed on any flexible racket cover or other sheath.

Yet another object of the invention is to provide a ball holder which can be replaced relatively easily in the event it becomes damaged.

Other objects will in part be obvious and will in part appear hereinafter.

The invention accordingly comprises the features of construction, combination of elements and arrangement of parts which will be exemplified in the construction hereinafter set forth, and the scope of the invention will be indicated in the claims.

Briefly, the holder is comprised of a cage or container shaped to snugly accommodate two or more balls or other objects used with a racket. The container has an opening in one side which is at least slightly larger than the object in the holder. In use, the container is positioned with its open side down flush against the face of a flexible racket cover and the container is secured to the cover except around the opening. When the cover is on the racket, the racket holds the flexible cover taut so that it completely covers the opening, thereby securely retaining the balls within the container. However, when the cover is removed from the racket, it becomes limp, so that it falls away from and exposes the container opening, permitting balls to be inserted into or withdrawn from the container through the opening.

The present ball holder can be installed on any conventional racket cover or other flexible sheath. Furthermore, in the event it becomes damaged, it can be removed from the cover and replaced with a new container.

BRIEF DESCRIPTION OF THE DRAWING

For a fuller understanding of the nature and objects of the invention, reference should be had to the following detailed description taken in connection with the accompanying drawing, in which.

DESCRIPTION OF THE PREFERRED EMBODIMENT

Figures 1, 2, 3, 4:
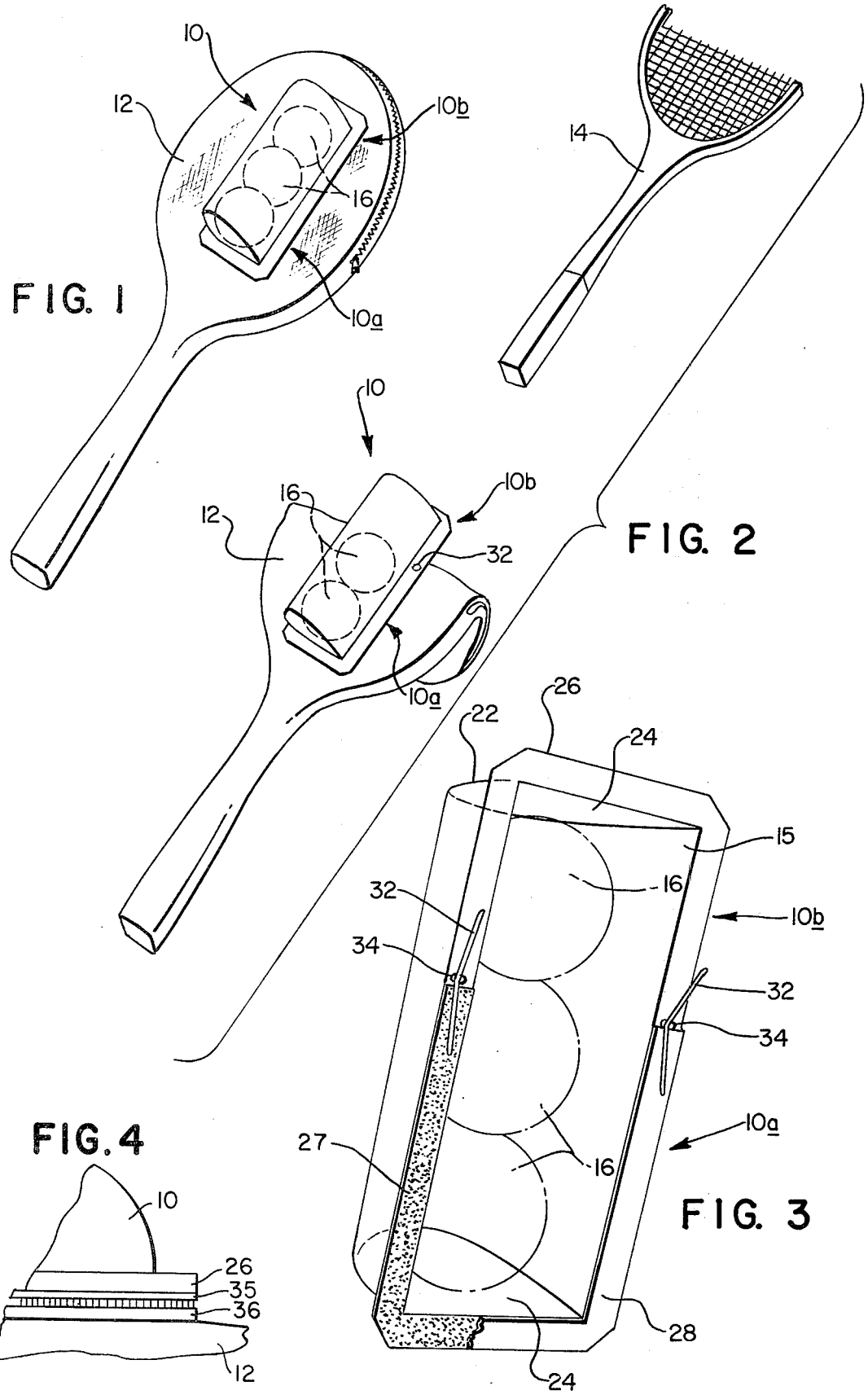
FIG. 1 is a perspective view of a holder made in accordance with this invention affixed to a flexible cover on a racket with the container shown in its closed condition.
FIG. 2 is a similar view of the holder with the cover removed from the racket showing the holder in its open condition.
FIG. 3 is a similar view on a larger scale showing the holder in greater detail.
FIG. 4 is an end view of an alternate embodiment of the invention.

Turning now to FIG. 1 of the drawing, the subject holder indicated generally at 10 is installed on a conventional, flexible, unsupported cover 12 on a tennis racket 14 (FIG. 2). While we have specifically illustrated a cover 12 which encloses the entire racket 14, the invention is equally applicable to the type of cover which only encloses the strung portion of the racket.

Holder 10 has a lower portion **10*a* which is secured to the cover 12 and an upper portion 10*b* which is not secured to the cover. Furthermore, the rear side of the holder portion 10*b*, i.e. the side facing the cover 12, has an opening 15** (FIG. 3).

The holder 10 is shaped and arranged to hold a plurality, herein three, tennis balls 16 indicated in dotted lines. As long as the cover 12 is on the tennis racket 14 (FIG. 2), the racket holds the cover material taut so that it presses against and completely closes the part of opening 15 (FIG. 3) in the holder portion **10*b*. Consequently, the balls 16** are securely retained within the holder.

However, when the cover 12 is removed from the racket 14 as shown in FIG. 2, the cover material becomes limp so that it falls away from and exposes the part of opening 15 (FIG. 3) in the holder portion **10*b* (FIG. 2). Therefore, a ball 16** can be inserted into or withdrawn from the holder through the opening.

Turning now to FIG. 3, the holder 10 is substantially rigid and is molded or otherwise formed of a suitable, inexpensive, relatively stiff, lightweight plastic material. It consists of a semicylindrical shell 22 whose radius and length enable it to accommodate three tennis balls 16. The ends of the shell 22 are closed off by semicircular end walls 24. However, the rear side of the shell is open in a plane at 15 and a rectangular flange 26 extends around the edge of the opening.

Suitable means are provided for attaching the holder portion **10*b* to the face of cover 12. In the illustrated embodiment, the attaching means are an adhesive strip 27 which is applied to the underside of flange 26, but which covers only that part of the flange in the holder portion 10*a*. In other words, the adhesive strip 27 extends all around the opening 15, except for an upper part thereof which is slightly larger than the ball 16 diameter. Also, the adhesive strip 27 is provided with a stripable liner tape 28 to protect the adhesive until the ball holder is actually installed on the cover 12**.

A pair of brass fasteners 32 are inserted through holes 34 in flange 26 at points just above the ends of the strip 26 on each side of the opening 15. The fasteners are adapted to be inserted through holes in the cover 12 after which their tines are spread apart to securely anchor the shell to the cover at those points. This is done to reinforce the securement between shell and cover at the points where the cover hinges away from the shell adjacent the adhesive strip 27 when the cover is limp as shown in FIG. 2. This insures that the cover does not pull away from the flange 26 after repeated flexings of the cover along that hinge line.

Of course, any other suitable means for attaching the shell or cage to the racket cover may be employed. For example, the shell or cage may be stitched or stapled through flange 26 to the cover. Alternatively, as shown in FIG. 4, the adhesive strip 27 can be replaced by a strip 35 of hook and eye fabric such as is sold under the trademark Velcro, a mating strip 36 of this material being adhered to the cover 12. This arrangement enables the holder 10 to be removed from the cover at will.

It should be understood that the holder 10 can be of most any shape. The only requirement is that it be able to cage two or more balls, shuttlecocks or other such playing objects and that it have an opening in the side facing cover 12 which is at least large enough to permit insertion of the playing object into the holder. For example, the holder portion 10*a* can be closed, if desired, without interfering with the operation of the holder, Finally, the holder should include means for securing it to the cover, except in the region of the opening.

It will thus be seen that the object set forth above, amont those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described.

I claim:

1. A holder for playing objects designed to be struck by a racket, said holder comprising A. an unsupported cover of flexible material for the racket, said cover being held taut by the racket when the racket is in the cover and being limp when the racket is removed, and B. a substantially rigid cage for storing playing objects therein, said cage having an opening in one plane thereof through which the playing objects pass and having a first portion in said plane adjacent the opening for attachment tautly to a first exterior area of said cover and a second portion which is detached from said cover adjacent said first area, and C. means for attaching said first cage portion to said cover whereby said cover closes the opening when the racket is in said cover and falls away from the opening at said detached portion when the racket is removed from said cover.

2. The holder defined in claim 1 wherein said cage is composed of a generally cylindrical hollow shell whose diameter and length are such that said shell can accommodate two or more balls and a flange extending around the edge of said shell and wherein said attaching means secure said flange to the cover except where said flange extends around the opening.

3. The holder defined in claim 2 wherein said attaching means are comprised of an adhesive applied to the face of said flange which is arranged to face said cover.

4. The holder defined in claim 3 wherein said attaching means further comprise fastening elements attached to said flange at points just below the opening and on each side thereof, said fastening elements being arranged to mechanically engage said cover.

5. The holder defined in claim 2 wherein said attaching means comprise a strip of hook and eye material covering the face of the flange which is arranged to face the cover except where the flange extends around the opening, said strip being arranged to mate with a correspondingly arranged strip of said material secured to the cover.

* * * * *